US006864442B1

(12) United States Patent
Zegula et al.

(10) Patent No.: US 6,864,442 B1
(45) Date of Patent: Mar. 8, 2005

(54) OPERATIONAL CONTROL HAVING A SPRING WIPER CONTACT

(75) Inventors: Oliver Zegula, Bad Neustadt (DE); Thomas Ofenhitzer, Salz (DE); Gerold Eckert, Bad Neustadt (DE); Joachim Storath, Salz (DE)

(73) Assignee: Preh GmbH, Bad Neustadt (DE)

( * ) Notice: Subject to any disclaimer, the term of this patent is extended or adjusted under 35 U.S.C. 154(b) by 0 days.

(21) Appl. No.: 10/853,165

(22) Filed: May 26, 2004

(51) Int. Cl.[7] ..... H01H 19/00
(52) U.S. Cl. ..... 200/11 DA; 200/571
(58) Field of Search ..... 200/11 R–11 H, 200/564, 570, 571, 336, 292

(56) References Cited

U.S. PATENT DOCUMENTS 3,356,817 A * 12/1967 William et al. ..... 200/260
3,588,392 A * 6/1971 Cartwright ..... 200/11 A
4,275,279 A * 6/1981 Wagatsuma et al. .... 200/11 DA
5,422,448 A * 6/1995 Nakano et al. ..... 200/11 DA
5,705,778 A * 1/1998 Matsui et al. ..... 200/11 R
5,736,696 A 4/1998 Del Rosso
6,423,915 B1 * 7/2002 Winter ..... 200/292

FOREIGN PATENT DOCUMENTS

DE 43 19 543 A1 12/1994
DE 101 11 400 A1 9/2002
EP 0 414 941 A1 3/1991

* cited by examiner

*Primary Examiner*—Michael A. Friedhofer

(57) ABSTRACT

An operational control is provided for setting an actuating variable, more particularly a set point for a motor vehicle air conditioner, having a rotary knob, having at least two contact tracks and one elastic wiper contact element that is in contact by means of at least one wiper contact with a contact track, wherein the contact tracks are joined to the rotary knob so as to be nonrotatable with respect thereto and in that the wiper contact elements are provided with an additional elastic wiper contact facing the printed circuit board.

17 Claims, 2 Drawing Sheets

OPERATIONAL CONTROL HAVING A SPRING WIPER CONTACT

BACKGROUND OF THE INVENTION

1. Field of the Invention

The present invention relates to an operational control for setting an actuating variable, more particularly a set point for a motor vehicle air conditioner, with a rotary knob, having at least two contact tracks and one spring wiper contact element that is in wiper contact with at least one contact track.

2. Description of the Background Art

Operational controls are often used in which wiper contacts are moved over contact tracks, for example in order to adjust a variable electrical resistance. The wiper contact element here can be fastened directly to the rotary knob of the operational control or can work together with the rotary knob. Such an operational control for actuating an air distribution flap in a motor vehicle air conditioning and/or ventilation device is known from EP 0 414 941 A1. In order to change the set point, a manually operated rotary control knob is moved through a certain angle and a wiper contact element is drawn over three concentric contact-making contact tracks. The wiper contact element is fastened to a separate disk that is mounted on the axis of the rotary knob. The disk carrying the wiper contact element is moved by a dog that is arranged on the rotary knob of the operational control. In order to compensate for the tolerances in the direction of the contact tracks, the ends of the wiper contacts are bent in a V-shape in the direction of the contact tracks. The wiper contact element is thereby rigidly attached to the rotary disk.

Another wiper contact element is disclosed in DE 101 11 400 A1. The wiper contact element here is also called a wiper, and is rotationally fixed to a gear that carries the wiper contact element. A printed circuit board is arranged directly beneath the wiper contact element. Contact tracks that the wiper contacts of the wiper contact elements slide over are applied to the printed circuit board. To improve the reliability of the contact, every wiper contact has two elastic wiper contacts. The wiper has two wiper arms, where wiper contacts are successively arranged in radial alignment on one wiper arm, while only one wiper contact is located on the other wiper arm.

From DE 43 19 543 A1 is known an automotive light switch with a rotary/push-pull switch accommodated in a housing for the parking and driving lights and interior illumination. In order to be able to perform additional light switch operations with such a switch, a regulating switch for headlight leveling and a regulating switch for the dashboard lighting are additionally installed in the housing. This automotive light switch is characterized in that each regulating switch constitutes an electrical switch with a resistance, adjustable by a spring wiper that is placed on the printed circuit board and is used to control the power consumption of electrical loads. The spring wiper here is arranged on the side of the printed circuit board opposite the adjusting wheel and is actuated by means of a rotatably mounted lever. The spring wiper here is mounted beneath the printed circuit board such that it can move.

SUMMARY OF THE INVENTION

It is therefore an object of the present invention to provide a wiper contact element and an arrangement of a wiper contact element in an operational control that are of simple design and that minimize the tolerance problems between the receptacle for the wiper contact elements and the printed circuit board or the contact tracks, and thus facilitate reliable contact. Furthermore, the wiper contact element to be developed should be inexpensive to manufacture and require minimal effort to install in the operational control.

This object is attained in accordance with the invention in that the contact tracks are joined to the rotary knob so as to be nonrotatable with respect thereto and in that the wiper contact elements are provided with an additional elastic wiper contact facing the printed circuit board. The arrangement according to the invention of a wiper contact element that has elastic wiper contacts facing in both directions, which is to say facing the contact tracks located on the rotary knob and facing the printed circuit board, makes it possible to employ an operational control that minimizes the tolerances relative to both the printed circuit board and the contact tracks. The use of just one spring element—the term spring element is used here as a synonym for wiper contact element—makes it possible to implement the contact in an extremely economical manner and also with extremely simple design means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
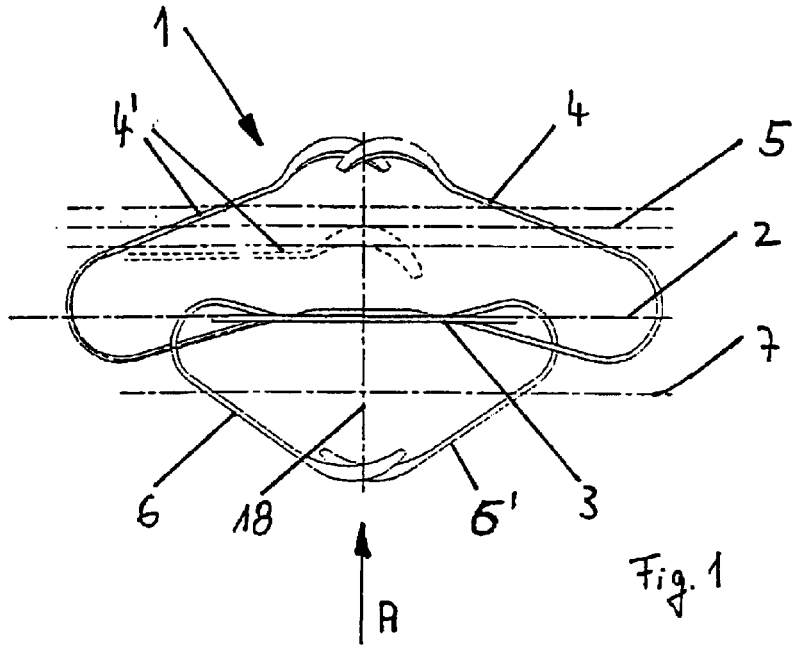
FIG. 1 is a side view of an example embodiment of a wiper contact element according to the invention.

FIG. 1 shows a side view of a wiper contact element 1 in the relaxed state prior to installation. In a mounting plane 2, the wiper contact element 1 has two laterally extending projections 3 with which the wiper contact element is held in the operational control. Extending out of the mounting plane 2 are two wiper contacts 4, 4' facing a contact track 5, and two wiper contacts 6, 6' facing a printed circuit board 7. The contact track 5 and the printed circuit board 7 are shown here only as dashed lines in order to clarify their positions with respect to the mounting plane 2. By way of example, the wiper contact 4' is shown in dashed lines in the operating position on the contact track 5.

As can also be seen in FIG. 1, the legs 4, 4' and 6, 6' of the wiper contact element 1 have different dimensions. The lengthened or shortened design in accordance with the invention of the individual wiper contacts 4, 4' and 6, 6' makes it possible to apply different preloadings to the contact track 5 and the printed circuit board 7. As a result of the different forces, different tolerances with respect to the mounting plane 2 can be compensated in relation to the contact track 5 and the printed circuit board 7. Depending on the design requirements for the operational control, it may be necessary to design the legs of the wiper contacts 4, 4' and 6, 6' with different lengths, and thus to establish a corresponding nominal dimension between the contact track 5 and the printed circuit board 7, to which contact is to be made. In this example embodiment, a relatively large tolerance is to be compensated in the direction of the contact track, in contrast to which only a small force can be accommodated or exerted by the longer wiper contacts 4, 4'. While a greater force is exerted by the shorter wiper contacts 6, 6' in the direction of the printed circuit board 7 between the mounting plane 2 and the printed circuit board 7, only a relatively small tolerance can be compensated. Depending on the design of the wiper contacts 4, 4' and 6, 6', which is to say different lengths of the spring arms 4, 4' and 6, 6', it is possible, for example, to establish a force ratio of 1 to 2, which is to say the force in the direction of the printed circuit board 7 is twice as great as the force in the direction of the contract track 5.

Figure 2:
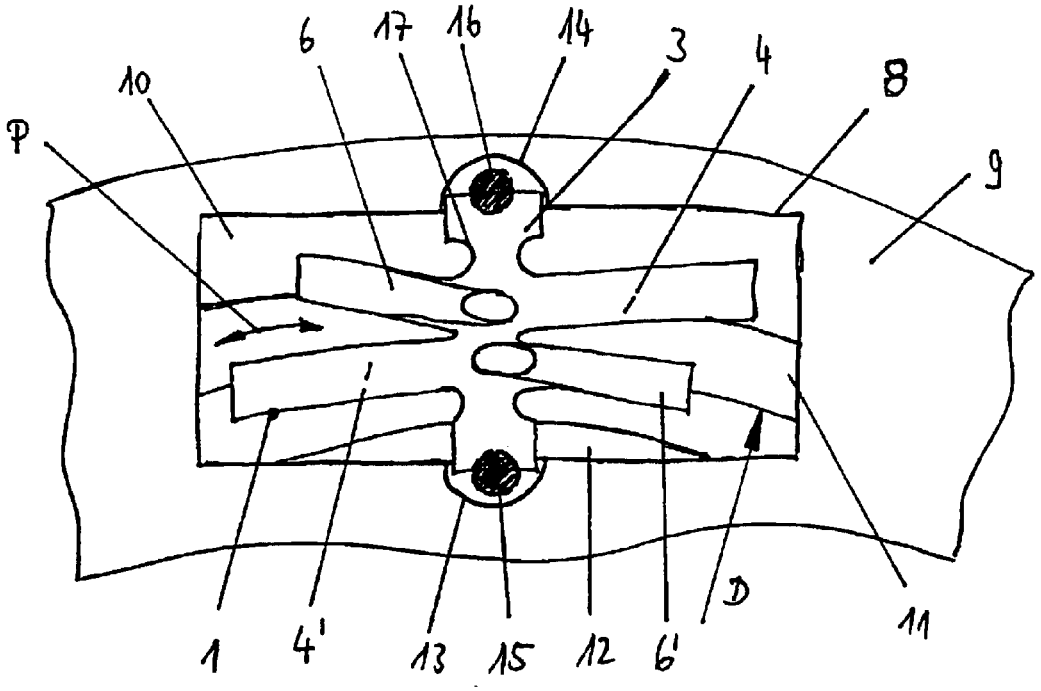
FIG. 2 is a view along A from FIG. 1 of a wiper contact element built into an operational control.
Figure 3:
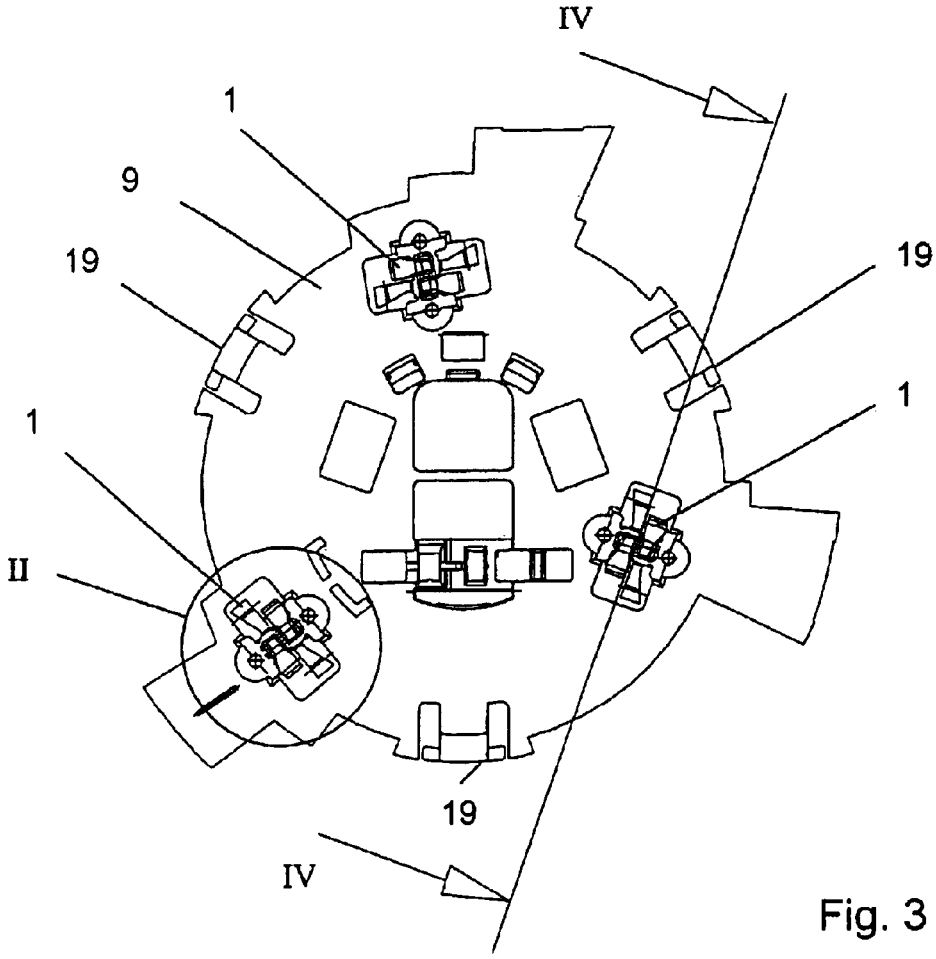
FIG. 3 is a top view of an underside of a rotary knob.

FIG. 2 shows the view along A from FIG. 1, and an enlarged view 11, of a wiper contact element 1 from FIG. 3 of the wiper contact element 1 in the installed state. The wiper contact element 1 is connected nonrotatably to a base 9 in a through opening 8 of the base 9 beneath a rotary knob 10. Contact tracks 11 and 12 on the underside of the rotary knob 10 are visible through the through opening 8. The wiper contact element 1 is laid in recesses 13, 14 of the base 9 and is joined at points 15, 16 to the base. In this example embodiment, a connection to points 15, 16 is made by pressing a part of the plastic from which the base 9 is manufactured that projects from the base 9. However, it is also possible to join the wiper contact element 1 to the base 9 in a removable manner. Known fastening options such as clips, snap-in attachments, screws, rivets, adhesives, etc. are available for this purpose.

The wiper contact element 1 is located immediately above the contact track 11 in such a manner that the two wiper contacts 4, 4' are in connection with the contact track 11. It can also be seen that only one contact track is contacted by the wiper contact element 1. An additional wiper contact element 1 is necessary in order to make contact with a contact track 12, which is located further inward at a diameter D. Thus it is possible in accordance with the invention to arrange any desired number of wiper contact elements in the base of the operational control. It is preferred to arrange three contact tracks 11, 12 and three wiper contact elements 1 in one operational control.

When the rotary knob 10, of which only the underside is visible in FIG. 2 through the opening 8, moves in the direction of the arrow P, the contact track 11 slides over the contacts of the wiper contacts 4, 4' and an actuating variable of the operational control is changed. For example, if the operational control is designed as a potentiometer, three contact tracks 11, 12 are present on the rotary knob 10 as annular tracks. The first contact track 11, 12 would carry chassis, the second contact track 11, 12 would form a ground, and the third contact track 11, 12 would then be the resistive layer across which the voltage would be distributed. The diameter D of the contact tracks 11, 12 vary by 2 to 2.5 mm in this example embodiment.

The rotary knob 10 is rotatably mounted on the base 9 and is in electrical contact through the wiper contact element 1 with the printed circuit board 7, not shown in FIG. 2. In this configuration, the wiper contacts 6, 6' are in almost static contact with the printed circuit board 7. Since the rotary knob 10 is held in the base 9 against the spring force of the wiper contact element 1, the rotary knob 10 can also be described as being float mounted. The wiper contact element 1 likewise acts against the printed circuit board 7 solely through the spring force of the wiper contacts 4, 4' and 6, 6'. The projections 3 on the wiper contact elements 1 have a taper 17 so that the wiper contact element 1 is merely positioned and guided in the base 9. The wiper contact element thus offers optimal tolerance compensation between the printed circuit board 7 and the contact track 5. So that the forces from the wiper contacts 4, 4' and 6, 6' work optimally together, the wiper contacts 4, 4' and 6, 6' are opposing, which is to say they are curved in different directions opposite to one another. Thus, for example, the wiper contact 6' is curved against the printed circuit board 7 and the opposing wiper contact 4' is curved against the contact track 5. For this reason, the spring force acts on a center 18 of the wiper contact element 1, which is also indicated in FIG. 1 by the dashed center line 18. In addition, the wiper contacts 4, 6 are curved in the opposite direction. Thus not only is the force from the wiper contact element 1 kept in the center 18, but tilting or rotation of the wiper contact element 1 is avoided by this means as well.

It should be noted that conventional materials can be used as materials for the wipers, wiper contact elements and wiper springs, which are used synonymously here.

A further advantage that results from the use of the wiper contact element 1 in accordance with the invention is that, as a result of this contact method, the position of the wiper contact element 1 relative to the contact track on the rotary knob 10 is no longer dependent on the position of the printed circuit board 7 to which the wiper contact element 1 was generally fastened. Thus, the tolerance problems between the printed circuit board 7 and the plastic parts from which the base 9 and the rotary knob 10 are manufactured have been eliminated. Moreover, the manufacturing step in which the wiper contact element 1 was fastened to the printed circuit board is eliminated.

FIG. 3 shows a top view of the base 9 on the underside of the rotary knob 10. In this example embodiment, three wiper contact elements 1 are built into the rotary knob 10 at different diameters. As is clearly visible, the wiper contact elements 1 are arranged at different diameters with respect to the center point of the circular rotary knob 10 and are Arranged in order to attach the base 9 to the upper part of the rotary knob 10.

Figure 4:
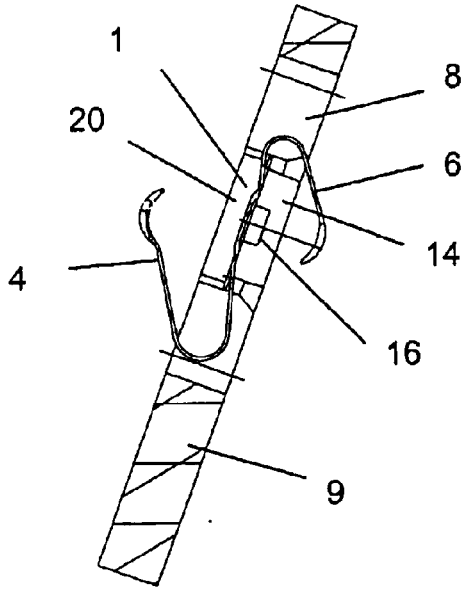
FIG. 4 is a side view of a cross-section IV—IV of a wiper contact element.

FIG. 4 shows a cross-section through a wiper contact element 1 along the line IV—IV from FIG. 3. The wiper contact element 1 rests on an area 20 in a recess 14 of the base 9. In this case, the wiper contact element 1 is fastened to the base 9 in the area of the recess 14 by pressing a section of plastic 16 projecting from the base 9. The entire contact spring 1 sits in the through opening 8.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An operational control for setting an actuating variable, the operational control comprising:

a rotary knob that includes at least two contact tracks, the contact tracks being fixed to the rotary knob so as to rotate with the rotary knob; and at least one wiper contact element that includes a first wiper contact and a second wiper contact, the first wiper contact providing contact with at least one of the two contact tracks, the second wiper contact providing contact with a printed circuit board.

2. The operational control from claim 1, wherein at least one wiper contact element is fastened in a base that accommodates the rotary knob, and wherein the rotary knob is float mounted in the base against a spring force of at least one wiper contact element.

3. The operational control according to claim 2, wherein the base is fastened in a fixed location relative to the printed circuit board, and wherein the base is float mounted on the printed circuit board against the spring force of at least one wiper contact element.

4. The operational control according to claim 1, wherein the first wiper contact has different dimensions than the second wiper contact.

5. The operational control according to claim 1, wherein the at least two contact tracks, which are provided on the rotary knob, are each associated with a separate wiper contact element.

6. The operational control according to claim 1, wherein the first wiper contact and the second wiper contact each have two contact points.

7. The operational control according to claim 1, wherein the first wiper contact and the second wiper contact of the wiper contact element form four oppositely curved wiper contact points so that two of the curved wiper contact points of the first wiper contact act in the direction of the contact tracks and two wiper contacts of the second wiper contact act in the direction of the printed circuit board.

8. The operational control according to claim 1, wherein three separate contact tracks are provided on the rotary knob and wherein at least one of the contact tracks is a resistance track so that the operational control can be implemented as a variable resistance.

9. The operational control according to claim 1, wherein the contact tracks are arranged at different diameters on the rotary knob.

10. The operation control according to claim 1, wherein the actuating variable that is set by the operation control is a set point for a motor vehicle air conditioner.

11. An operational control comprising:

a rotary knob having at least one contact track formed on a bottom area of the rotary knob, the rotary knob rotating about a rotary axis;

a printed circuit board;

a first wiper contact being provided substantially between at least one contact track of the rotary knob and a mounting plane, the mounting plane being formed between at least one contact track and the printed circuit board; and a second wiper contact being provided substantially between the printed circuit board and the mounting plane, the first wiper contact and the second wiper contact providing electrical connectivity between at least one contact track of the rotary knob and the printed circuit board, wherein a width of the first wiper contact is substantially different than a width of the second wiper contact such that an exertion force of the first wiper contact is different than an exertion force of the second wiper contact, the width of the first and second wiper contacts extending along the mounting plane and perpendicular to the rotary axis.

12. The operational control according to claim 11, wherein the exertion force of the first wiper contact and the exertion force of the second wiper contact is based on the width of the first wiper contact and the width of the second wiper contact, respectively.

13. The operational control according to claim 11, wherein a segment of the first wiper contact that contacts the contact track of the rotary knob is curved and wherein a segment of the second wiper contact that contacts the printed circuit board is curved.

14. An operational control comprising:

a rotary knob having at least one contact track formed on a bottom area of the rotary knob, the rotary knob rotating about a rotary axis;

a printed circuit board;

a plurality of contact elements being provided within apertures of a base, each of the plurality of contact elements including:

a first wiper contact being provided substantially between at least one contact track of the rotary knob and a mounting plane, the mounting plane being formed between at least one contact track and the printed circuit board; and a second wiper contact being provided substantially between the printed circuit board and the mounting plane, the first wiper contact and the second wiper contact providing electrical connectivity between the contact track of the rotary knob and the printed circuit board, wherein each of the plurality of contact elements are positioned on the base at a different distance from the rotary axis of the rotary knob such that a different signal is provided to the printed circuit board from each of the plurality of contact elements on the basis of a rotary position of the rotary knob.

15. A contact assembly comprising:

a spring element being provided between a first contact point and a second contact point for providing electrical conductivity between the first contact point and the second contact point, wherein four projections extend from a central area of the spring element, two of the four projections being formed so as to curve towards the first contact point and two of the four projections being formed so as to curve towards the second contact point, wherein the two projections that curve towards the first contact point extend outwards from the central area at a greater distance that the two projections that curve towards the second contact point, and wherein each of the two projections that curve towards the first contact point extend from the central area diagonally and opposite from one another and each of the two projections that curve towards the second contact point extend outwards from the central area diagonally and opposite from one another.

16. The contact assembly according to claim 15, wherein the first contact point is formed on a bottom surface of a rotary knob and wherein the second contact point is formed on a printed circuit board.

17. The contact assembly according to claim 15, wherein the four projections each exhibit a spring force on the basis of the distance that each of the projections extends outwards from the central area.

* * * * *